US010611610B2

(12) United States Patent
Borøy et al.

(10) Patent No.: US 10,611,610 B2
(45) Date of Patent: Apr. 7, 2020

(54) OFFSHORE LIFTING CRANE

(71) Applicant: National Oilwell Varco Norway AS, Kristiansand S (NO)

(72) Inventors: Yngvar Borøy, Søgne (NO); Ricardo Correia, Kristiansand S (NO); Hugo Lacerda, Kristiansand (NO); Thor Strand, Kristiansand (NO)

(73) Assignee: National Oilwell Varco Norway AS (NO)

( * ) Notice: Subject to any disclaimer, the term of this patent is extended or adjusted under 35 U.S.C. 154(b) by 10 days.

(21) Appl. No.: 15/560,064

(22) PCT Filed: Mar. 16, 2016

(86) PCT No.: PCT/NO2016/050047
§ 371 (c)(1),
(2) Date: Sep. 20, 2017

(87) PCT Pub. No.: WO2016/159777
PCT Pub. Date: Oct. 6, 2016

(65) Prior Publication Data

US 2018/0079631 A1 Mar. 22, 2018

(30) Foreign Application Priority Data

Mar. 27, 2015 (EP) ..... 15161240

(51) Int. Cl.
*B66C 23/52* (2006.01)
*B63B 27/08* (2006.01)
(Continued)

(52) U.S. Cl.
CPC ..... *B66C 23/52* (2013.01); *B63B 27/08* (2013.01); *B63B 27/10* (2013.01); *B63B 27/30* (2013.01);
(Continued)

(58) Field of Classification Search
CPC ..... B63B 27/30; B63B 27/10; B63B 27/08; B66C 13/10; B66C 23/68; B66C 23/52; B66D 1/36
See application file for complete search history.

(56) References Cited

U.S. PATENT DOCUMENTS 675,811 A * 6/1901 Burrel ..... B66C 23/52 212/309
3,572,380 A * 3/1971 Jackson ..... B66C 23/80 137/565.01

FOREIGN PATENT DOCUMENTS

DE 9302631 7/1994
EP 15161240.5 3/2016
(Continued)

OTHER PUBLICATIONS espacenet.com, translation of FR2463093 (Year: 2018).*
(Continued)

*Primary Examiner* — Michael R Mansen
*Assistant Examiner* — Nathaniel L Adams
(74) *Attorney, Agent, or Firm* — Conley Rose, P.C.

(57) ABSTRACT

Described is an offshore lifting crane, as for a vessel or platform, that includes a support structure, a crane boom connected to the support structure, a winch drum rotatable around its longitudinal axis, a winch drum drive means, and an elongated hoisting member. The hoisting member includes a first end connected to the winch drum and a second end connectable to a load. The hoisting member extends over at least a part of the crane boom, and the winch drum is arranged such that its longitudinal axis is substantially vertical.

20 Claims, 7 Drawing Sheets

(51) Int. Cl.

| | |
|---|---|
| ***B63B 27/10*** | (2006.01) |
| ***B63B 27/30*** | (2006.01) |
| ***B66C 13/10*** | (2006.01) |
| ***B66D 1/36*** | (2006.01) |
| *B66C 23/68* | (2006.01) |

(52) U.S. Cl.
CPC ..... *B66C 13/10* (2013.01); *B66D 1/36* (2013.01); *B66C 23/68* (2013.01)

(56) References Cited

FOREIGN PATENT DOCUMENTS

| | | |
|---|---|---|
| FR | 2463093 | 2/1981 |
| WO | 2014014343 | 1/2014 |
| WO | 2014025253 | 2/2014 |

OTHER PUBLICATIONS

International Preliminary Report on Patentability for PCT/NO2016/050047 dated Jun. 12, 2107 (20 pages).
Written Opinion for PCT/NO2016/050047 dated Mar. 4, 2016 (6 pages).
International Search Report for PCT/NO2016/050047 dated Apr. 5, 2016 (3 Pages).
Published PCT/NO2016/050047 dated Oct. 6, 2016 (22 pages).
English Translation of abstract to FR 2463093.

* cited by examiner

OFFSHORE LIFTING CRANE

CROSS REFERENCE TO RELATED APPLICATIONS

This application is the U.S. National Stage entry under 35 U.S.C. § 371 of International Patent Application No. PCT/NO2016/050047, filed Mar. 16, 2016, and entitled "Offshore Lifting System," and European Patent Application No. 15161240.5 filed Mar. 27, 2015, and entitled "Offshore Lifting System," each of which being incorporated herein by reference in their entirety for all purposes.

TECHNOLOGICAL FIELD

None

BACKGROUND

This present disclosure relates to an offshore lifting crane. More specifically the disclosure relates to an offshore lifting crane comprising a support structure, a crane boom connected to said support structure, a winch drum rotatable around a longitudinal axis thereof, a winch drum drive means and an elongated hoisting member having a first end connected to said winch and a second end connectable to a load, said elongated hoisting member extending over at least a part of said crane boom.

Offshore lifting cranes and their related equipment are getting increasingly large and heavy in order to keep up with the requirements for lifting continually heavier loads often in increasingly deep waters. Lifting cranes for deep water operations need winch drums suitable for storing several thousand meters of wire rope, often in the order of 3000 meters or more, thus requiring large, heavy winch drums with equally large footprints. For hoisting loads in deep water operations it is often desirable to use fibre ropes due to their reduced weight compared to traditional steel wire ropes. However, fibre ropes stored on winch drums operating in heave compensation mode and accommodating more than two layers of fibre rope are subject to unacceptable wear, leading to an unacceptable short lifetime of the fibre rope. The excessive wear results mainly from a reduced radial stiffness of the fibre rope due to heating resulting from friction in repeated bending cycles in heave compensation.

As an example, a 250 short tons crane dimensioned for subsea hoisting operations down to 3000 meters, using fibre rope stored in no more than two layers on a winch drum with a diameter of 6 metres, will require the winch drum to be approximately 8 meters long. It goes without saying that such a long winch drum would be very unpractical to place on a vessel, either on a crane or below deck. As such, it is currently not feasible to use fibre ropes on large actively heave-compensated offshore subsea crane-/winch systems. Further, a winch drum and its drive means are often placed at an upper portion of an offshore crane, typically on a platform above the crane housing, the platform extending horizontally away from the crane housing in the opposite direction of the crane boom, thus giving the crane a tail swing and a relatively high centre of gravity. For very large crane-winch systems this has been solved by providing the winch below deck of the vessel on which the lifting crane is installed. This however, has the drawback of significantly complicating the installation, thus increasing installation time and cost.

Thus, the present disclosure provides an offshore lifting crane suitable for deepwater hoisting operations with heavy loads, even in heave compensation, where the footprint of the winch an winch drum, and preferably also the overall weight of the crane-winch system, is reduced. The present disclosure offers an easy installation of the offshore crane on a vessel so as to reduce installation time and cost.

FR 2463093 discloses a compact lifting crane with a winch drum and a spooling device included inside the mast of the crane.

WO 2014/025253 A1 discloses crane vessel and a method for lowering an object from such a vessel into the sea.

BRIEF SUMMARY OF THE DISCLOSURE

The present disclosure is directed to remedy or to reduce at least one of the drawbacks of the prior art, or at least provide a useful alternative to prior art.

The present disclosure relates more specifically of an offshore lifting crane comprising

- a support structure;
- a crane boom connected to said support structure;
- a winch drum rotatable around a longitudinal axis thereof;
- a winch drum drive means; and
- an elongated hoisting member having a first end connected to said winch drum and a second end connectable to a load, said elongated hoisting member extending over at least a part of said crane boom, wherein said winch drum is arranged such that said longitudinal axis thereof is substantially vertical, and wherein said winch drum is integrated with said support structure.

In use on a vessel, the longitudinal axis of said winch drum may depart slightly from strictly vertical as a result of the vessel's movement due to wind and sea.

The offshore lifting crane according to the present disclosure may be any type of lifting crane used offshore, and the disclosure is not limited to any specific type of lifting cranes. However, the embodiments described herein may be especially useful for pedestal-mounted offshore cranes, and in particular for knuckle-boom cranes.

By arranging the winch drum substantially vertically, the potentially large footprint of a long winch drum may be significantly reduced. Further advantages of various exemplary embodiments will be explained in the following.

The crane support structure, with which the winch drum is integrated, will typically include at least a pedestal placed on, or extending through, the deck of a vessel on which the lifting crane is provided, the pedestal constituting a lower portion of the crane support structure. The support structure will typically also comprise a king, rotatably connected to the pedestal above the pedestal, and a crane housing above the king, the king and the housing constituting an upper portion of said crane support structure. Said winch drum may be integrated with any part of said support structure, thus making possible a compact lifting crane structure.

In a at least some embodiments, said winch drum may be connected to and rotatable around a part of said crane support structure, such as around a crane king of said support structure. This particularly compact design offers a number of advantages as will be clear from the description below. In an embodiment where the winch drum surrounds the crane king, the crane king may be made longer than usual so as to extend all the way from a crane boom or crane housing and down to a relatively low pedestal. In total, this gives no extra height compared to the normal height of a lifting crane according to the prior art, while the whole space normally occupied solely by the winch drum, crane-mounted or below deck-mounted, may be substantially saved. Compared to a crane-mounted winch drum, this may also lower the centre of gravity of the crane, thus contributing to a more stable ship/vessel. It typically also lowers the total weight of the crane as there is no need to provide a separate fundament/platform for the winch.

Another significant advantage of making the winch drum an integrated part of the crane support structure, and in particular by connecting it rotatably around the crane king, is that is possible to pre-mount and pre-test the crane-winch system onshore before installing the system on the ship/vessel. In comparison, systems with below deck-mounted winches and drive means typically require in the order of two to three months of offshore, i.e. on-ship, testing before use. It goes without saying that such a long on-ship testing period may be very expensive.

The winch drum itself will typically be connected to and around a part of the crane support structure, such as the crane king, by means of an upper slew bearing and a lower slew bearing preferably adapted to take up both axial and radial forces. The slew bearings may leave room for winch drum drive means on both sides of the winch drum, though in one embodiment the winch drum drive means may be provided on only one side of the winch drum. Each end of the winch drum is typically provided with a small flange, the flanges being connected to one slew bearing each. On one or both sides of the winch drum, the slew bearing may be integrated with gear teeth on the inner or outer race. One or more motor-driven pinions engage with the gear teeth to rotate the winch drum. The motors and gears, constituting the winch drum drive means, may be provided inside the crane support structure, typically inside the crane king, or externally on the crane support structure. In at least one embodiment, said drive means may be a plurality of electric motors, such as a plurality of permanent magnet motors, or hydraulic motors.

In one exemplary embodiment, said crane support structure may comprise a slew bearing, said slew bearing being provided below said winch drum, and said slew bearing enabling said crane king with said winch drum to rotate relative to a crane pedestal around an axis substantially coinciding with said longitudinal axis of the winch drum. This slew bearing must not be confused with the slew bearings used for connecting the winch drum to the crane support structure. This slew bearing may be of a type commonly used on pedestal-mounted offshore lifting cranes. The rotation axis of the pedestal slew bearing will typically coincide with the longitudinal axis of the winch drum, but there may be a small radial offset due to play in the slew bearings.

There is also described herein an embodiment where the winch drum may be provided at a distance from the crane support structure, in contrast to the winch drum being connected to or integrated with the crane support structure. The winch drum could be placed anywhere on the vessel, while its vertical arrangement will still save space on board the vessel. In one exemplary embodiment, the winch drum could be provided below or partially below deck. It would be within the competence of the skilled person to provide a set of sheaves to guide the elongated hoisting member from a winch drum placed at a distance from the lifting crane support structure and to the boom of the lifting crane.

In an exemplary embodiment, said lifting crane may comprise a spooling means comprising one or more sheaves for directing the elongated hoisting member substantially perpendicularly onto and/or from the winch drum. Depending on the type of offshore crane used, it may be necessary to assist the winch in spooling the elongated hoisting member onto the winch drum. The spooling means may include one or more direction changing means, typically in the form of one or more sheaves, for changing the direction of the elongated hoisting member from the winch boom to the winch drum. The one or more sheaves included in the spooling means will typically change the direction of the elongated hoisting member by around 90° each.

In an exemplary embodiment, one of said sheaves in the spooling means may be longitudinally displaceable substantially in parallel with said longitudinal axis of said winch drum. The sheave may be displaceable on an arm or rail or the like, where the arm/rail may be connected to the crane support structure. This way the fleet angle may be reduced so that the elongated hoisting member may be spooled more or less perpendicularly onto the winch drum in any position along the winch drum. In addition to the longitudinally displaceable sheave, the spooling means may comprise one or more non-displaceable sheaves. The displaceable sheave may be displaced by means of a drive means, typically in the form of a couple of actuators. The actuators may be of any type directly or indirectly connected to the displaceable sheave and adapted to move it up and down along the winch drum. In an exemplary embodiment, the actuator may be a hydraulic actuator, whereas in another embodiment, the actuator may be an electric actuator, such as an electric actuator including a rack and pinion.

In another exemplary embodiment, the above-mentioned displaceable sheave may also be tiltable around an axis substantially coinciding with the axis along which the sheave is displaceable, which may improve the spooling angle when used with an elongated hoisting member stored in more than two layers on the winch drum. It may not be necessary with a tiltable sheave when used together with fibre ropes stored in no more than two layers on the winch drum.

In another exemplary embodiment, the elongated hoisting member may comprise fibre rope, implying that the whole or at least a part of the wire rope may comprise fibre rope. It is well known that fibre ropes are significantly less heavy than wire ropes made from steel. Depending on the type of wire rope used the weight may be reduced in the range of 10-20 times compared to a standard steel wire rope in air, thus also leading to an overall reduced weight of the crane-winch system. The significantly reduced weight of the elongated hoisting member together with a vertically arranged winch drum make it possible to work with heavier loads in deeper waters, as the buoyancy in water will substantially compensate the weight of the fibre wire rope, in contrast to a steel wire rope, where the full length of a steel wire rope in deepwater hoisting operations contributes to a significant portion of the maximum lifting capacity of an offshore lifting crane. In some embodiments, the winch drum may be formed with a groove, typically a helical groove, to accommodate the inner layer of fibre rope on the winch drum. The groove may further prevent a second layer of fibre rope on the winch drum to fall in between the coils of the first layer, thus preventing excessive wear on the fibre wire rope. In some embodiments, the elongated hoisting member may be a hybrid rope or a steel wire.

In an exemplary embodiment, the offshore lifting crane may be provided with heave compensation means. The heave compensation means may be integrated in the winch as will be known to a person skilled in the art. As described above, wear on a wire rope may be significant in heave compensation, as the wire rope undergoes numerous bending cycles, often over the same portion of the wire rope. The use of a large diameter winch drum and relatively large diameter sheaves may increase the lifetime of a wire rope, and in particular wire ropes used in heave compensation mode, due to an increased so-called D/d ratio, where D is the diameter of the winch drum or a sheave in the crane-winch system, while d is the diameter of the wire rope itself.

In an exemplary embodiment, the winch drum may be provided in a material comprising a steel and concrete composite. The composite has a lower mass density than steel, while still offering sufficient strength. The weight of the winch drum, and thereby also of the winch-crane system, may thus be further reduced.

There is also described a vessel provided with an offshore lifting crane according to the above description.

BRIEF DESCRIPTION OF THE DRAWINGS

Exemplary embodiments described herein are illustrated in the accompanying drawings, wherein.

DETAILED DESCRIPTION OF THE DISCLOSED EXEMPLARY EMBODIMENTS

Figure 1:
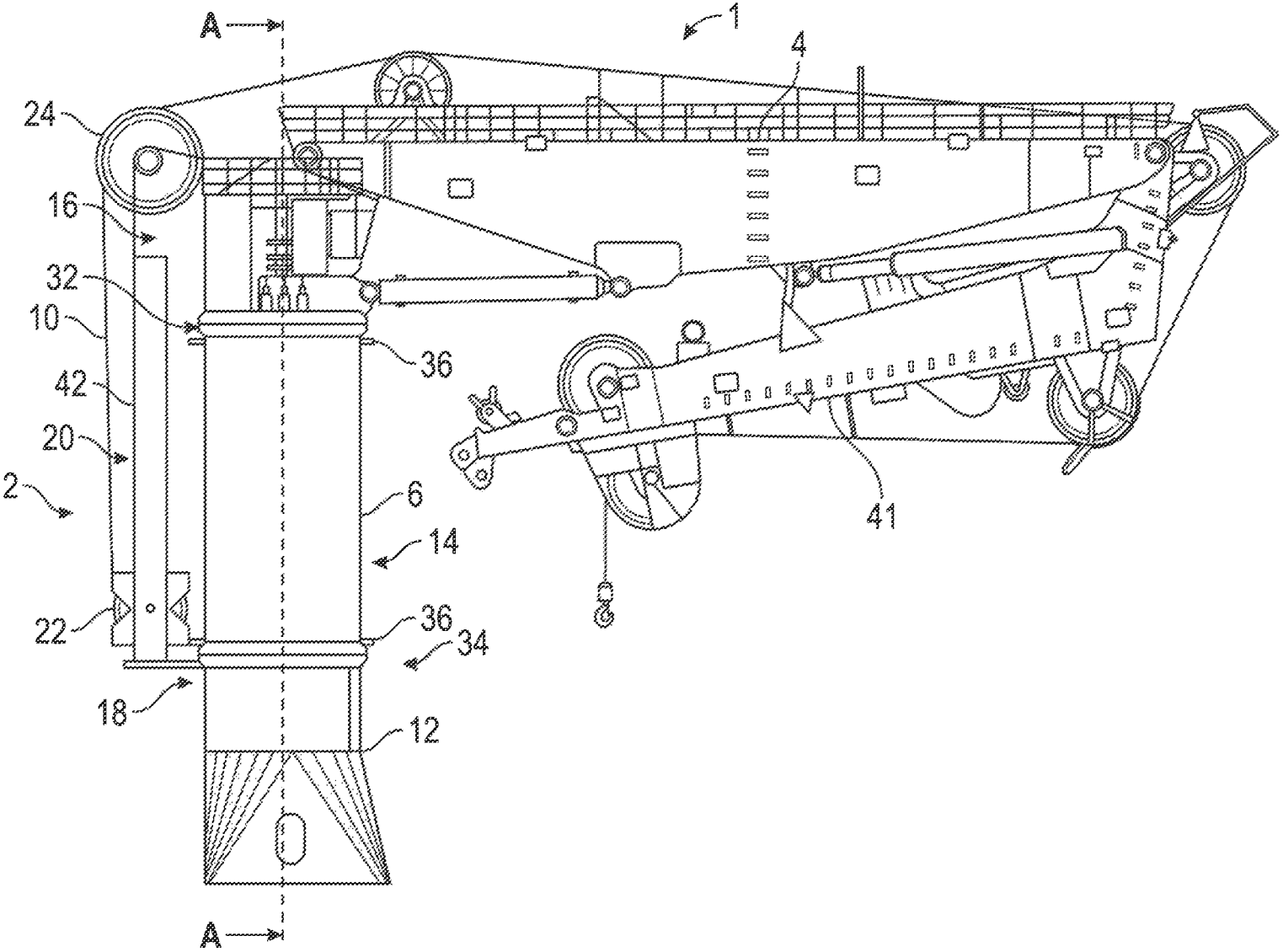
FIG. 1 shows, in a side view, an offshore lifting crane according to the present disclosure.

In the following, the reference numeral 1 will indicate an offshore lifting crane according to the present disclosure, whereas the reference numeral 30 indicates a vessel provided with such an offshore lifting crane. Identical reference numerals refer to identical or similar features in the figures. The figures are simplified and schematic, and the various features in the figures are not necessarily drawn to scale.

Figure 2:
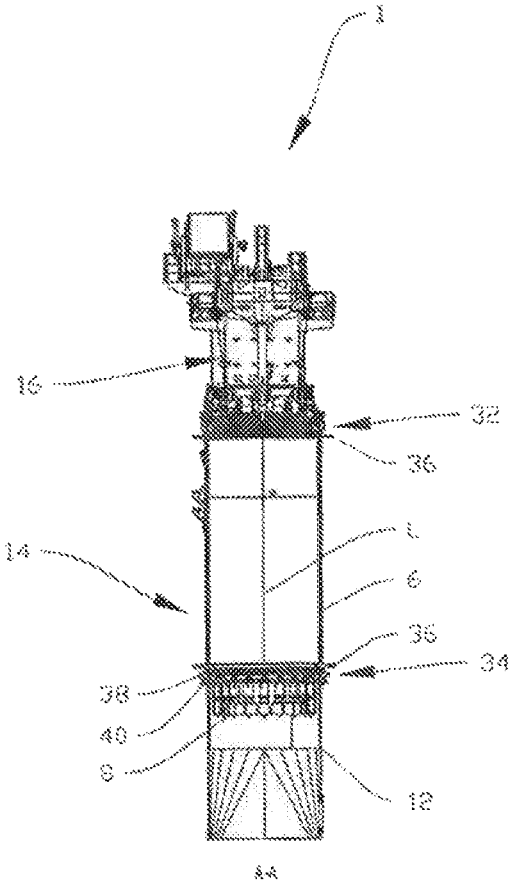
FIG. 2 shows, in a cross-sectional view, the offshore lifting crane as seen through the line A-A in FIG. 1.

Reference is first made to FIGS. 1 and 2 showing a first embodiment of an offshore lifting crane 1 according to the present disclosure in the form of a knuckle-boom crane. The knuckle-boom crane 1 comprises a support structure 2, the support structure 2 including a lower portion including a pedestal 12 and an upper portion including a crane king 14 and a housing 16. The crane 1 comprises two crane booms; a main boom 4 and a knuckle-boom 41, the main boom 4 being pivotally connected to the housing 16 and the knuckle-boom 41 being pivotally connected to the distal end of the main boom 4. The general luffing motion of the main boom 4 and the knuckle-boom 41 will be known to a person skilled in the art, and will therefore not be described in detail herein. In the shown embodiment, a winch drum 6 is rotatably connected to the crane support structure 2, around the crane king 14, thus providing a very compact lifting crane. Compared to a not shown knuckle-boom crane according to the prior art, the skilled person will recognize that the king 14 has been made longer so that it extends all the way down from the housing 16 and to a lowered pedestal slew bearing 18, enabling the rest of the knuckle-boom crane 1 to rotate relative to the pedestal 12 around and axis substantially parallel to a longitudinal axis L of the winch drum 6. The winch drum 6 is rotatably connected around the crane king 14 by means of an upper slew bearing 32 and a lower slew bearing 34, thus enabling the winch drum 6 to rotate around the crane king 14 independently from the crane king's 14 rotation relative to the pedestal around the pedestal slew bearing 18.

Figure 5:
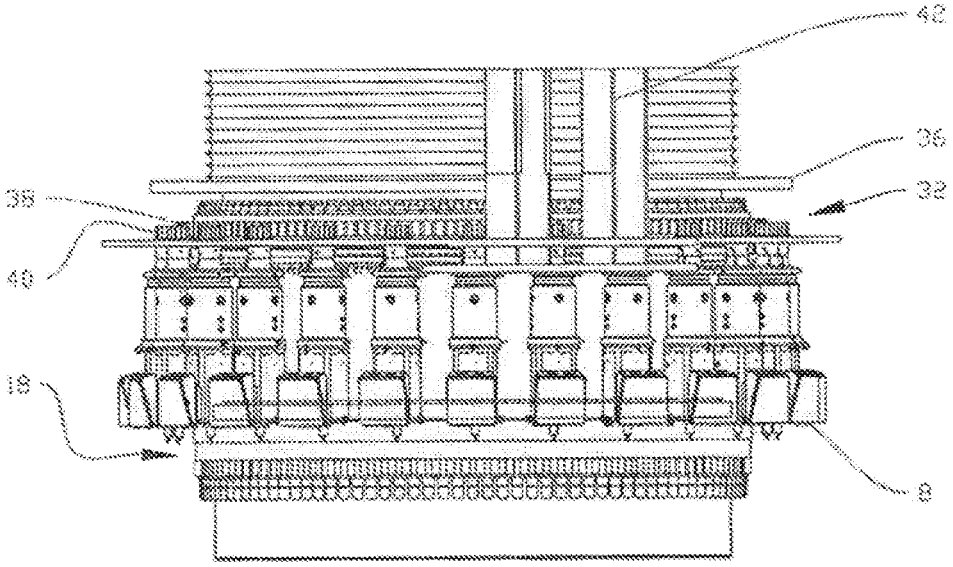
FIG. 5 shows, in a rear view, an enlarged detail of the lifting crane of FIG. 4.

In the exemplary embodiment shown in FIGS. 1-2, the winch drum 6 is adapted to be rotated by means of winch drum drive means 8 provided inside the crane support structure 2 in the pedestal 12 as can be seen in the cross-sectional view in FIG. 2. The drive means 8 comprises a plurality of electric motors and gears, each of which is provided with a rotatable shaft with a gear pinion 40 at its end, each gear pinions 40 engaging with gear teeth 38 integrated with the inner race of the lower slew bearing 34. The lower slew bearing 34 in turn being connected to the winch drum 6 by being connected/bolted to a winch drum flange 36. In FIGS. 1-2, the winch drum 6 is shown only driven by electric motors at its lower end. The details of the winch drum flange 36, the lower winch drum slew bearing 34, and the drive means 8 are not easily seen in FIGS. 1 and 2 due to the scale of the drawings. Reference is therefore made to FIG. 5 for a detailed view of an equivalent embodiment, though with the drive means 8 provided on the outside of the crane support structure.

An elongated hoisting member 10 in the form of a fibre rope extends from the winch drum 6 along the crane king 14 and housing 16 and over the main boom 4 and knuckle-boom 41, where a free end of the fibre rope is connectable to a load, typically by means of a hook or the like. In order to direct the fibre rope 10 onto/from the winch drum 6 and to reduce the fleet angle, the knuckle-boom crane 1 is provided with a spooling means 20, in the shown embodiment comprising a displaceable sheave 22, a fixed sheave 24 and a drive means 26 for the displaceable sheave, where the drive means 26 is only shown with reference to FIGS. 3 and 4 as discussed below. The two sheaves 22, 24 change the direction of the fibre rope 10 by approximately 90° each. The displaceable sheave 22 is linearly displaceable in rails/arms 42 substantially parallel to the longitudinal axis L of the winch drum 6, so as to direct the fibre rope 10 onto/from the winch drum 6 while substantially minimizing the fleet angle so as to position the fibre rope 10 in a helical groove on the winch drum 6.

Figure 3:
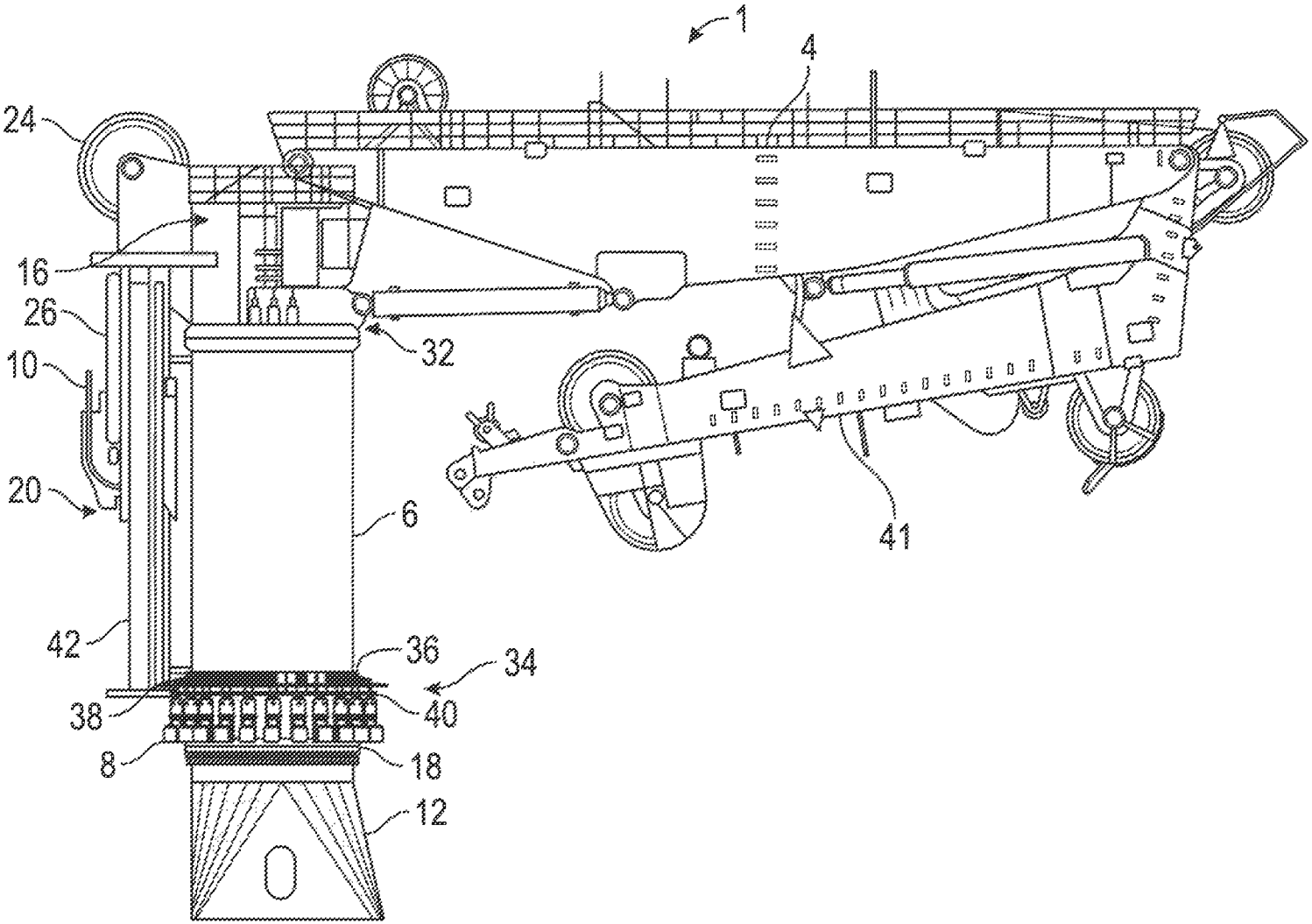
FIG. 3 shows, in a side view, an offshore lifting crane according to the present disclosure.
Figure 4:
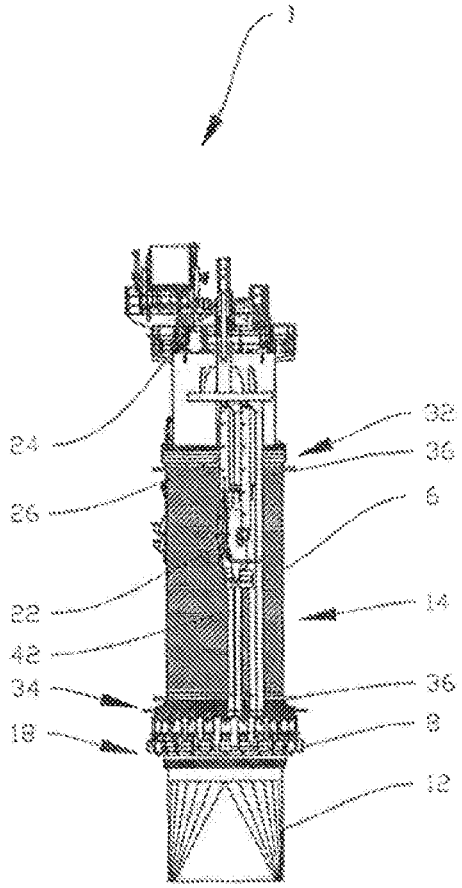
FIG. 4 shows, in a rear view, the offshore lifting crane of FIG. 3.

FIGS. 3-5 show another exemplary embodiment of an offshore lifting crane 1 according to the present disclosure. Only a small portion of the fibre rope 10 is shown in these figures. In this second embodiment, the winch drum drive means 8 is provided on the outside of the pedestal 12, the gear pinions 40 of the electric motors engaging with gear teeth 38 integrated with an outer race of the lower winch drum slew bearing 34, as can be best seen in the enlarged view in FIG. 5. Further, the spooling device 20 is shown in some more detail, where the displaceable sheave 22 is displaceable by means of hydraulic actuators 26 adapted to displace the sheave 22 in parallel with the longitudinal axis L of the winch drum 6 as indicated in FIG. 2. In other embodiments, other drive means, such as electric of pneumatic actuators, may be used to move the displaceable sheave 22. In the shown embodiment, the displaceable sheave 22 is also tiltable around an axis substantially coinciding with the axis along which the sheave 22 is displaceable, though not strictly necessary when used with fibre ropes 10 stored in no more than two layers on the winch drum 6.

FIG. 5 is an enlarged view of the lower part of the knuckle-boom crane 1 of FIG. 4. The figure shows a lower part of the winch drum 6 with the drum flange 36, the drum flange 36 being connected to the lower winch drum slew bearing 34. The lower winch drum slew bearing 34 having gear teeth 38 integrated with its outer race. Gear pinions 40 rotatable by means of the electric motors 8 engage with the gear teeth. The pedestal slew bearing 18 is shown below and partially behind the electric motors 8. The pedestal slew bearing 18, and the rotation of the rest of the offshore lifting crane 1 relative to the pedestal 12 will be known to a person skilled in the art, and will not be discussed in further detail herein.

Figure 6:
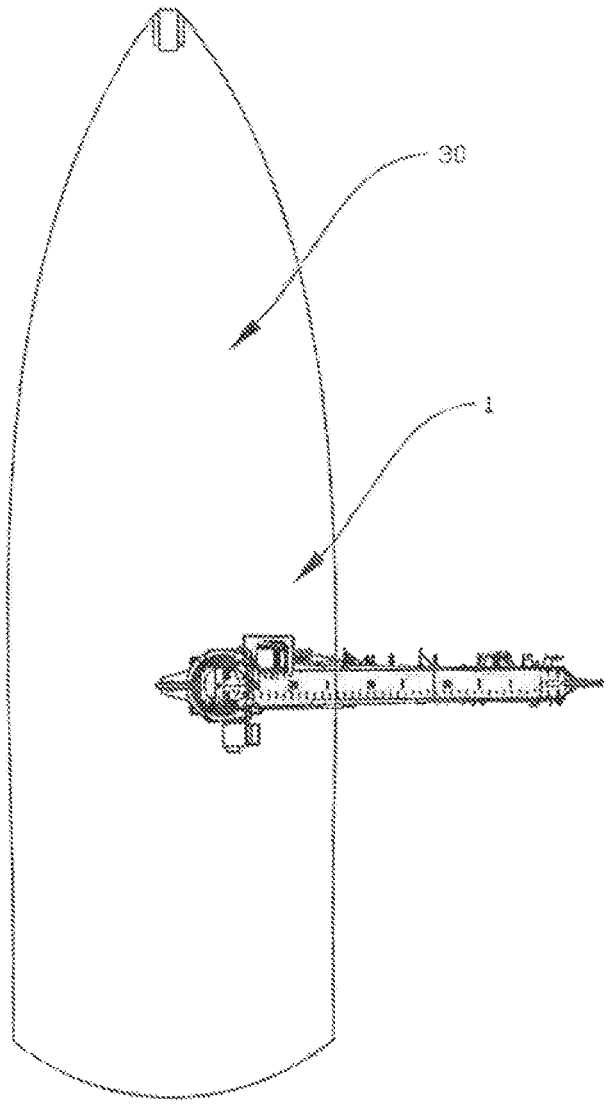
FIG. 6 shows, in a top view, a vessel provided with an offshore lifting crane according to the present disclosure.
Figure 7:
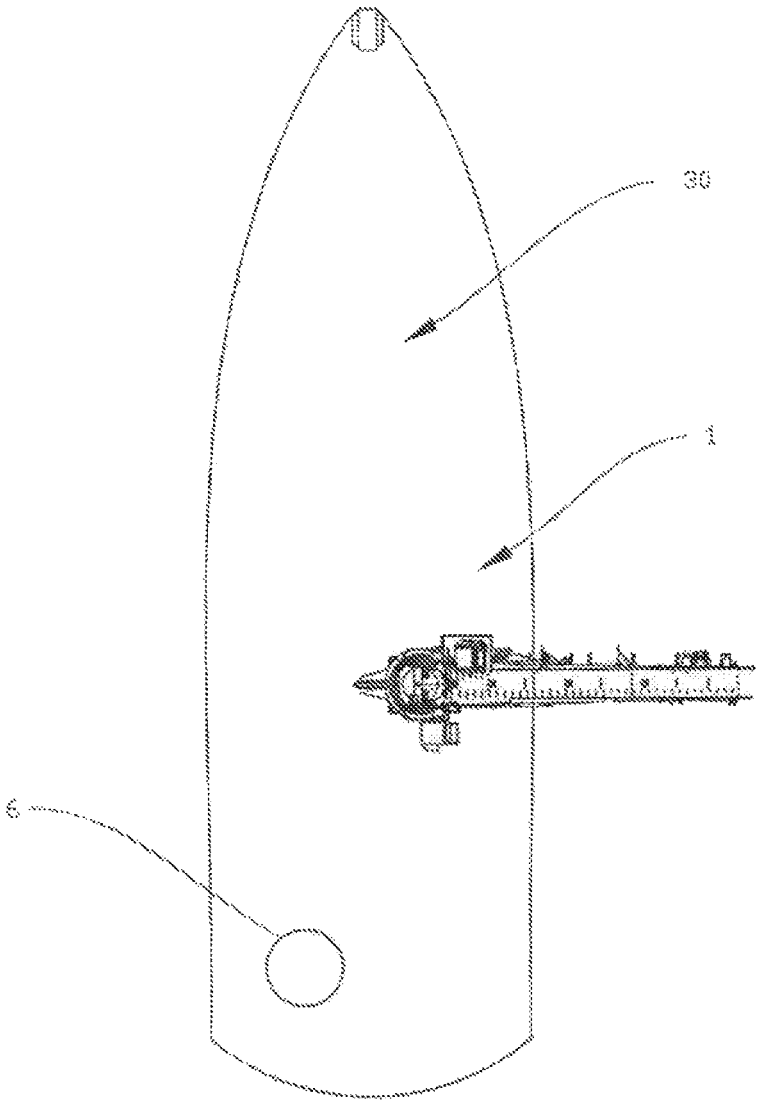
FIG. 7 shows, in a top view, a vessel provided with another embodiment of an offshore lifting crane according to the present disclosure.

FIG. 6 shows a vessel 30 provided with an offshore lifting crane 1 according to the present disclosure. As discussed above, the offshore lifting crane 1 according to the present disclosure, and in particular according to the above-described embodiments, when used on a vessel 30 offers the advantages of compactness, reduced tail swing and lower centre of gravity and the possibility of hoisting larger loads into deeper waters as compared to offshore lifting cranes according to the prior art. FIG. 7 shows another embodiment, where the winch drum 6 is provided at a distance from the rest of the offshore lifting crane 1. The winch drum 6 may be provided on deck, below deck or as extending through deck, while its vertical arrangement still reduces the footprint compared to winch drums according to the prior art.

It should be noted that the above-mentioned embodiments illustrate rather than limit the present disclosure, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. Offshore lifting crane comprising:

a support structure;

a crane boom connected to said support structure;

a winch drum surrounding a crane king of the support structure, wherein the winch drum is rotatable around a longitudinal axis of the winch drum and wherein the crane king extends through the winch drum;

a winch drum drive means; and an elongated hoisting member having a first end connected to said winch drum and a second end connectable to a load, said elongated hoisting member extending over at least a part of said crane boom, wherein said winch drum is arranged such that said longitudinal axis is substantially vertical, wherein said winch drum is integrated with said support structure.

2. The offshore lifting crane according to claim 1, wherein said winch drum is connected to and rotatable around a portion of the crane support structure.

3. The offshore lifting crane according to claim 2, wherein said crane support structure comprises a slew bearing provided below said winch drum, said slew bearing enabling an upper portion of said crane support structure to rotate relative to a lower portion of said crane support structure around an axis substantially coinciding with said longitudinal axis of the winch drum.

4. The offshore lifting crane according to claim 3, wherein said winch drum drive means is provided inside said crane support structure.

5. The offshore lifting crane according to claim 4 wherein said winch drum drive means is provided inside the crane king of the crane support structure.

6. The offshore lifting crane according to claim 2 wherein said winch drum is connected to and rotatable around the crane king.

7. The offshore lifting crane according to claim 1, wherein said offshore lifting crane comprises a spooling assembly for spooling said elongated hoisting member onto and/or from said winch drum.

8. The offshore lifting crane according to claim 7, wherein the spooling assembly comprises one or more sheaves for directing said elongated hosting member substantially perpendicularly onto the winch drum.

9. The offshore lifting crane according to claim 8, wherein said spooling assembly further comprises a second sheave, and wherein a first sheave is displaceable substantially in parallel with said longitudinal axis of said winch drum.

10. The offshore lifting crane according to claim 1, wherein said elongated hoisting member comprises fibre rope.

11. The offshore lifting crane according to claim 1, wherein the lifting crane is provided with a heave compensation means.

12. The offshore lifting crane according to claim 1, wherein said winch drum is provided in a material comprising a steel and concrete composite.

13. A vessel comprising an offshore lifting crane according to claim 1.

14. Offshore lifting crane comprising:

a support structure;

a crane boom connected to said support structure;

a winch drum rotatable around a longitudinal axis of the winch drum;

a winch drum drive means; and an elongated hoisting member having a first end connected to said winch drum and a second end connectable to a load, said elongated hoisting member extending over at least a part of said crane boom, wherein said winch drum is arranged such that said longitudinal axis is substantially vertical, wherein said winch drum is integrated with and surrounds an outer portion of said support structure;

wherein said crane support structure comprises a slew bearing configured to enable the crane boom to rotate about the longitudinal axis of the winch drum.

15. The offshore lifting crane according to claim 14, wherein said winch drum is connected to and rotatable around a portion of the crane support structure.

16. The offshore lifting crane according to claim 14, wherein said winch drum drive means is provided inside said crane support structure.

17. The offshore lifting crane according to claim 14, wherein said offshore lifting crane comprises a spooling assembly for spooling said elongated hoisting member onto and/or from said winch drum.

18. The offshore lifting crane according to claim 17, wherein the spooling assembly comprises one or more sheaves for directing said elongated hosting member substantially perpendicularly onto the winch drum.

19. The offshore lifting crane according to claim 18, wherein said spooling assembly further comprises a second sheave, and wherein a first sheave is displaceable substantially in parallel with said longitudinal axis of said winch drum.

20. The offshore lifting crane according to claim 14 wherein said winch drum is connected to and rotatable around a crane king of the crane support structure.

* * * * *